United States Patent [19]

Toncelli

[11] Patent Number: 4,738,218

[45] Date of Patent: Apr. 19, 1988

[54] ROTATING HEAD FOR AUTOMATICALLY COATING MATERIALS BASED ON MARBLE OR STONE AND THE LIKE

[76] Inventor: Marcello Toncelli, Via Giovanni XXIII, 2 - Bassano Del Grappa (Vicenza), Italy

[21] Appl. No.: 911,493

[22] Filed: Sep. 24, 1986

[30] Foreign Application Priority Data

Sep. 30, 1985 [IT] Italy ..... 85600 A/85

[51] Int. Cl.[4] ..... B05C 11/04

[52] U.S. Cl. ..... 118/111; 15/180; 118/411; 118/413

[58] Field of Search ..... 118/111, 411, 413; 15/180

[56] References Cited

U.S. PATENT DOCUMENTS

| | | | |
|---|---|---|---|
| 2,156,873 | 5/1939 | Scheurer | 118/111 |
| 3,732,590 | 5/1973 | Horst | 15/180 X |
| 4,219,898 | 9/1980 | Presby | 15/180 X |
| 4,461,127 | 7/1984 | Hanger | 15/180 X |

*Primary Examiner*—John P. McIntosh

*Attorney, Agent, or Firm*—Bucknam and Archer

[57] ABSTRACT

The rotating head comprises a predetermined number of blades being supported by a blade carrier arm (3), the latter being integral with the shaft (1). The blades are arranged on a vertical axis in suitably inclined positions, a fact which permits to carry out the automatic coating of the surface of the material by means of every type of material based on marble, stone and the like by means of every type of putty.

4 Claims, 2 Drawing Sheets

ROTATING HEAD FOR AUTOMATICALLY COATING MATERIALS BASED ON MARBLE OR STONE AND THE LIKE

The present invention relates to rotating heads and more specifically to a rotating head provided with blades which are inclined and orientable on their own vertical axis. The novel rotating head permits to carry out automatically the coating of the surface of materials based on marble or stone and the like by means of any type of adhesive, both of the cement type as well as the resin type.

It is well known that in the present state of the art it is possible to coat materials based on marble or stone or agglomerated material only in the case in which the coating is carried out by means of putty having a cement base.

When a putty of the resin type is used, it is necessary to use a device provided with blades which carry out an alternating motion or also a rotating motion. In both cases, it is necessary to provide means for containing the material in order to avoid the escape of the putty which has a tendency to avoid the action of the blades. The coating with the devices discussed hereinabove does not result always very effective for a number of reasons, such as, the scanty filling of the pores as well as the difficulty of spreading due to the rapid hardening of the putty.

The object of the present invention is to avoid the drawbacks described hereinabove. In fact it has been found that in order to achieve optimum coating, it is necessary to take into consideration the viscosity of the putty which is being spread because the time interval between the passage of two successive blades over one pore being coated must be greater with respect to the time interval required by the putty in order to achieve an equilibrium condition. In fact it has been noted that a blade which carries with it the adhesive being spread, when it goes through a cavity present in the marble or stone, causes part of the putty to flow into the interior of the cavity thus resulting in an action of solidification. The excess of the putty on the other hand has a tendency to flow on the areas which are already freed of the action of the blade. This motion requires a certain period of time which depends on the viscosity of the putty being used.

After the equilibrium has been reached, in the time interval, one obtains a cavity coated by a determined amount of the excess putty which is limited by a convex surface. It has also been found that only after this degree of equilibrium has been reached, it is possible to cause the successive blade to go over the material being coated without modifying the degree of coating of the cavity. In fact if a blade goes over the marble prior to the time when the putty has reached the equilibrium in the interior of the orifice, a certain amount of putty is carried away thus resulting in a pore which is not perfectly coated.

The apparatus according to the present invention provides for the blades to be carried individually by a blade-carrier arm 3 which is integral with the shaft 1 and further for the blades to be mounted substantially radially and at a certain interval with respect to one another. Further, the rate of rotation of the disk is such that after a cavity has been filled, the passage of another blade does not modify the coating already achieved.

It has also been observed that the lower border of one blade, particularly the border which has the tendency to displace the putty towards the exterior, should preferably be toothed so as to increase the specific pressure applied to the surface being coated.

With respect to the number of turns of the rotating head, it should be noted that it depends on the number of blades mounted on the shaft and the degree of viscosity of the putty. Clearly with a more viscous putty, the rate of rotation should be lower than with a more fluid putty.

Figure 1:
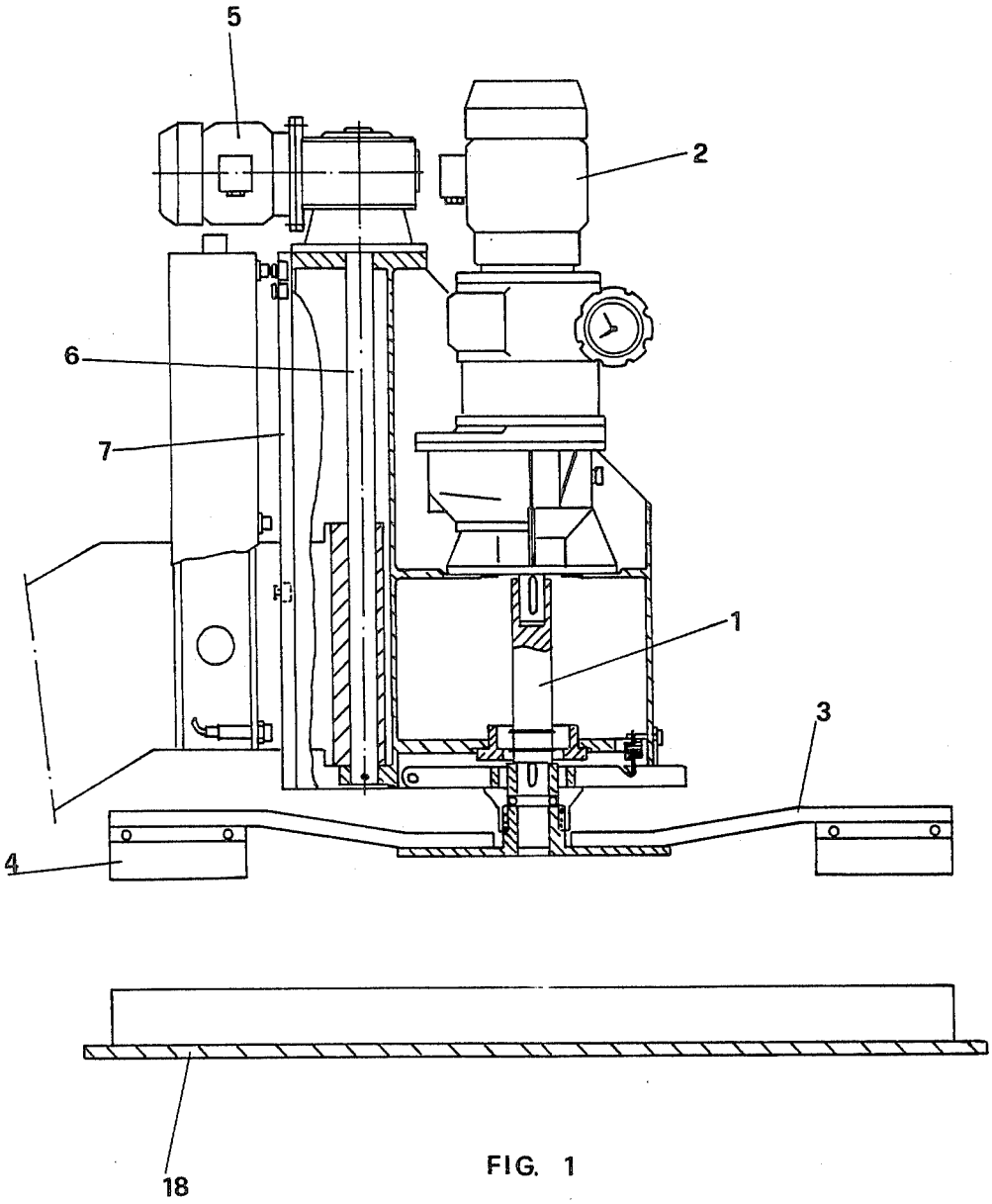
FIG. 1 illustrates a schematic side view of the rotating head partially in cross section.
Figure 2:
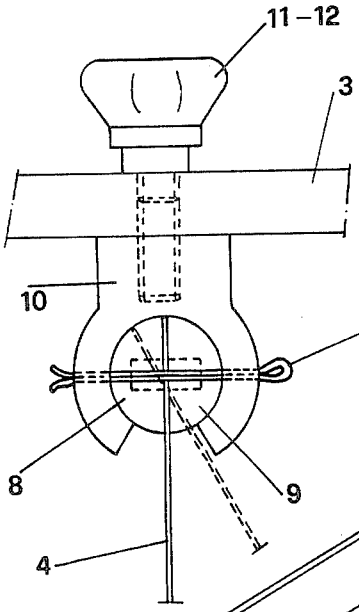
FIG. 2 illustrates one of the blades mounted on its respective carrier arm of which only a part is shown.

As shown particularly in FIG. 1, the rotating head comprises shaft 1 placed in rotation by a motor-variator 2, the speed of which is preestablished as a function of the diameter of the blades 4. The geared motor 5 by means of screw 6 causes the displacement of the head with respect to the guides 7 in the vertical direction, thus permitting the raising of the blade carrier arms 3 together with their related blades 4. Blades 4 as shown in FIG. 2 are blocked between two jaws 8 and 9 which are of semi-cylindrical shape and which are held within a vice 10 shown in FIG. 3. The vice in turn is mounted on the blade carrier arm 3 by means of clamps 11 and 12. The latter permit the variation of orientation with respect to the radial direction of the blade carrier arm 3.

Figure 3:
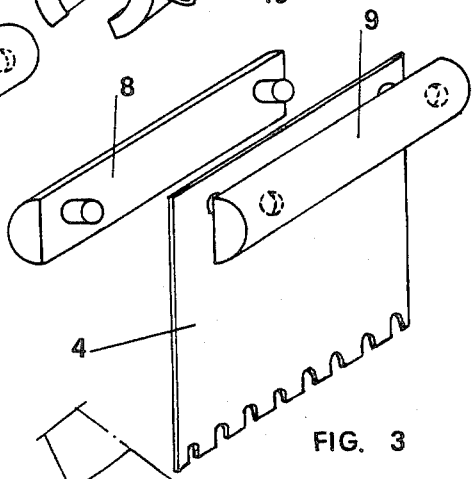
FIG. 3 is a perspective view of a blade with a toothed border together with its blocking means.

FIG. 3 shows that two series of orifices, 13 and 14 are made on clamp 10, for instance, three orifices each for the purpose of allowing the displacement of clamp 10 in a longitudinal direction, in the radial direction of the carrier arm 3.

Figure 5:
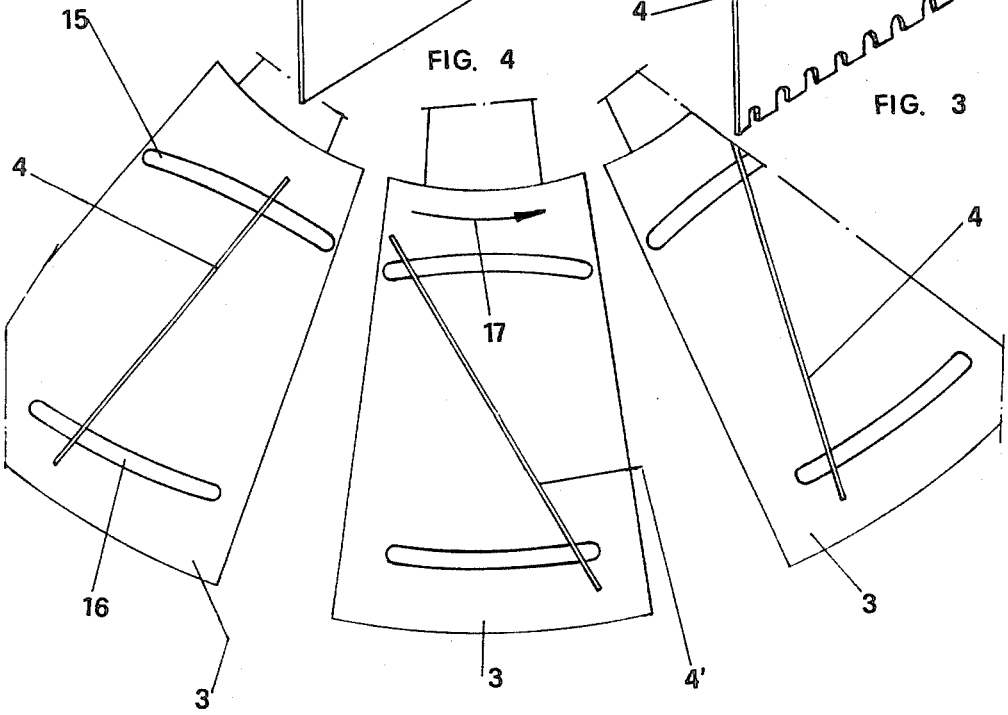
FIG. 5 illustrates schematically the position of a few blades mounted radially with respect to the related carrier arms.

The orientation of each blade, however, in an angular direction may be varied due to the presence of the oblong sectorial orifices 15 and 16 through which the blocking screws 11 and 12 pass, the blocking screws 11 and 12 fixing the position of clamp 10, as shown in FIG. 5.

Figure 4:
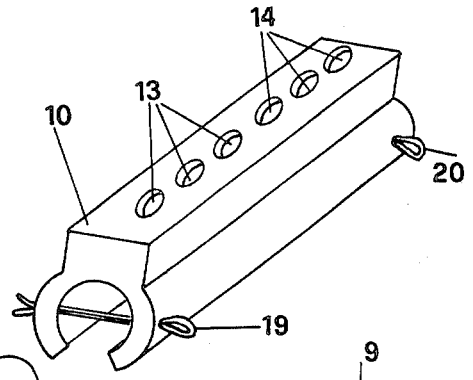
FIG. 4 illustrates in perspective view a blade with an even border together with its related fixing means.
Figure 4:
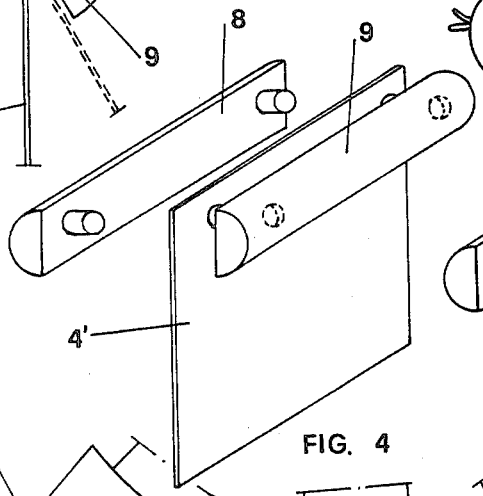

It should be noted that while blades 4 shown in FIG. 3 have a toothed border, blades 4' shown in FIG. 4 have an even border. Both blades 4 and 4' are mounted in such a manner as to be able to orient themselves differently with respect to the radial direction of the blade carrier arm 3 because there are provided slots 15 which have a circular sector and which permit the variation of orientation. In particular, blades 4 are so located as to cause the putty to go away towards the exterior while the blades 4' have a tendency to cause the putty to go towards the center of the rotating head when the direction of rotation of the head is as shown by the arrow 17 in FIG. 5. In this manner the present invention avoids the possibility that the putty be centrifuged towards the exterior or the interior of the surface being involved in the coating operation.

It should also be noted that each blade 4 or 4' is gripped between two semi-cylindrical jaws 8 and 9 due to the possibility of being more or less inclined according to the requirements, with respect to the plane of operation 18 shown in FIG. 1. Pins 19 and 20 avoid the accidental disengagement of the blades 4 and 4' from the clamp 10.

The blades 4 and 4' obviously are inclined during the operation and rotate up to the point when they rest against the border of clamp 10 as shown in dotted lines in FIG. 2. This serves the purpose of exerting on the slab being coated always the same degree of pressure.

Naturally the details of construction of the apparatus of the present invention may be varied while the essential characteristics of the invention are maintained.

What is claimed is:

1. A rotating head for automatically coating with a putty a slab based on marble, stone and the like which slab has pores on the surface thereof, which comprises a shaft, a plurality of blade carrier arms (3), mounted on said shaft, a plurality of blades (4, 4') mounted radially on said blade carrier arms and spaced with respect to each other, a motor variator placing said shaft in motion and placing said blade carrier arms in rotation on a vertical axis, said motor variator (2) adjusting the speed of rotation of said blade carrier arms (3) and means for automatically placing said blade carrier arms closer or further away from the plane of the slab during operation, said blades providing for spreading the putty on the slab during the longitudinal advance of the slab in a direction which is transversal with respect to the axis of rotation of the rotating head, whereby the entire surface of the slab is completely coated, said blades (4) being mounted on a pair of semi-cylindrical jaws (8, 9) held with a vice (10), said vice (10) being mounted on each of said carrier arms whereby the orientation of each of said blades with respect to the radial direction of each of said carrier arm may be varied.

2. The rotating head according to claim 1 wherein each blade is provided with a circular sector (15) whereby each blade is orientable in different directions with respect to the radial direction of the blade carrier arm on which it is mounted whereby said blade is inclined to cause said putty to flow towards the exterior and towards the interior of the head alternately, and said putty is completely spread in the interior of the slab being coated without flowing out and without requiring containing borders.

3. The rotating head according to claim 1, wherein said blades have alternately an even and a toothed border for the purpose of exerting a different degree of pressure on the pores of the slab and causing a forced hardening action of the putty and then a leveling action of the putty whereby a perfect coating is obtained while keeping constant the level of said pores present in the slab being coated.

4. The rotating head according to claim 1 wherein said vice (10) is mounted on each of said carrier arms by means of clamps (11, 12) and said vice has a plurality of orifices (13, 14) for insertion of said clamps.

* * * * *